US008047790B1

(12) United States Patent
Liang

(10) Patent No.: US 8,047,790 B1
(45) Date of Patent: Nov. 1, 2011

(54) NEAR WALL COMPARTMENT COOLED TURBINE BLADE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 64 days.

(21) Appl. No.: 12/944,978

(22) Filed: Nov. 12, 2010

Related U.S. Application Data

(63) Continuation of application No. 11/654,124, filed on Jan. 17, 2007, now abandoned.

(51) Int. Cl.
*F01D 5/18* (2006.01)

(52) U.S. Cl. ..... 416/97 R; 416/90 R

(58) Field of Classification Search ..... 415/115, 415/116; 416/90 R, 92, 96 R, 96 A, 97 R
See application file for complete search history.

(56) References Cited

U.S. PATENT DOCUMENTS 2,920,865 A * 1/1960 Lombard ..... 416/97 R
3,164,367 A * 1/1965 Lynch ..... 416/92
3,542,486 A * 11/1970 Adiutori et al. ..... 416/90 R
5,165,852 A * 11/1992 Lee et al. ..... 416/97 R
5,564,902 A * 10/1996 Tomita ..... 416/97 R
5,700,131 A * 12/1997 Hall et al. ..... 416/97 R
5,702,232 A * 12/1997 Moore ..... 416/95
5,941,687 A * 8/1999 Tubbs ..... 416/97 R
6,264,428 B1 * 7/2001 Dailey et al. ..... 416/97 R
6,565,312 B1 * 5/2003 Horn et al. ..... 415/115
6,632,069 B1 * 10/2003 Naljotov et al. ..... 415/173.5
7,033,136 B2 * 4/2006 Botrel et al. ..... 415/115
2002/0197160 A1 * 12/2002 Liang ..... 416/92

* cited by examiner

*Primary Examiner* — Christopher Verdier
(74) *Attorney, Agent, or Firm* — John Ryznic

(57) ABSTRACT

A turbine blade used in a gas turbine engine, the blade includes a plurality of cooled zones each with a plurality of radial extending cooling passages formed within the wall of the blade and connected to a separate collection cavity. A leading edge collection cavity is supplied with cooling air through a plurality of radial extending cooling channels located in the wall around the leading edge of the blade. Film cooling holes connected to the leading edge collection cavity discharge film cooling air to the leading edge. A pressure side collection cavity is supplied with cooling air from a plurality of pressure side radial extending cooling channels and discharges cooling air through film cooling holes on the pressure side. A suction side collection cavity is supplied with cooling air through a plurality of suction side radial cooling channels and discharges cooling air through suction side film cooling holes.

16 Claims, 4 Drawing Sheets

NEAR WALL COMPARTMENT COOLED TURBINE BLADE

CROSS-REFERENCE TO RELATED APPLICATIONS

This application is a CONTINUATION of U.S. Regular patent application Ser. No. 11/654,124 filed on Jan. 17, 2007 and entitled NEAR WALL COMPARTMENT COOLED TURBINE BLADE, now abandoned.

BACKGROUND OF THE INVENTION

1. Field of the Invention

The present invention relates generally to fluid reaction surfaces, and more specifically to turbine airfoils with a cooling circuit.

2. Description of the Related Art Including Information Disclosed Under 37 CFR 1.97 and 1.98

Turbine airfoils, such as rotor blades and stator vanes, pass cooling air through complex cooling circuits within the airfoil to provide cooling from the extreme heat loads on the airfoil. A gas turbine engine passes a high temperature gas flow through the turbine to produce power. The engine efficiency can be increased by increasing the temperature of the gas flow entering the turbine. Therefore, an increase in the airfoil cooling can result in an increase in engine efficiency.

Prior art airfoil cooling of blades with serpentine airfoil cooling circuits allows for the cooling air to communicate in between the mainstream pressure side and suction side. This cooling circuit design has to compromise the mainstream heat load and pressure distribution on the airfoil pressure and suction walls. FIG. 1 shows a prior art serpentine flow cooling circuit with a cooling cavity to provide cooling air for both the pressure and suction sides of the blade. A leading edge of the blade is cooled with a showerhead arrangement in which cooling air is supplied through a leading edge cooling supply channel 11, passes through a plurality of metering holes 12 and into a leading edge cavity 13, and then the cooling air is discharged out film cooling holes 14 that form the showerhead and gill holes. A mid-chord region of the blade is cooled by cooling air supplied through a first leg 15 of a three-pass serpentine forward flow circuit, and flows through the serpentine path into the second leg 16 and the third leg 17 in a forward direction from the trailing edge to the leading edge of the blade. Blade tip exit holes 23 also discharge cooling air from the serpentine flow circuit and out through the blade tip to provide cooling thereof. The first leg 15 of the serpentine flow circuit passes the cooling air through a series of three impingement holes 18, 19, 20 formed along the trailing edge of the blade before exiting out exit cooling air holes 21 spaced along the trailing edge of the blade. Film cooling holes 22 are located along the pressure side and suction side of the blade and connected to the first leg 15 of the serpentine flow circuit to provide film cooling to the outer surface of the blade. FIG. 1 also shows a schematic diagram representing the cooling air flow paths through the blade in FIG. 1.

U.S. Pat. No. 7,033,136 B2 issued to Botrel et al on Apr. 25, 2006 entitled COOLING CIRCUITS FOR A GAS TURBINE BLADE discloses a gas turbine blade best seen in FIG. 4 of this patent. The blade includes a first admission opening and a second admission opening formed in the root of the blade to supply pressurized cooling air to the blade cooling circuit. Cooling air from the admission openings flow into the suction side cavity or the pressure side cavity along the spanwise direction of the blade. The cooling air in these side cavities then flows into a common central cavity extending radially in the central portion of the blade between the suction side cavity and the pressure side cavity. According to FIG. 2 of this patent, two rows of film cooling holes are connected to the central cavity to discharge film cooling air onto the pressure side surface of the blade. One major difference between the Botrel patent and the present invention is that the pressure and suction side cavities are cavities and not individual radial channels. As such, the channels cannot be individually sized such that specific pressure and flow can be designed depending upon the hot metal temperature occurring on the blade. Another major difference is the use of a common central cavity used for both the pressure side supply cavity and the suction side supply cavity. Both supply cavities discharge into the common central cavity. In the present invention, separate collector cavities are used, one for the pressure side supply channels and one for the suction side supply channels. The use of separate collection cavities for the pressure and suction sides allow for better control of the pressure and flow distribution of the cooling air around the sections of the blade.

The object of the present invention is to provide for a turbine blade with multiple individual zones having independent designs based on the local heat load and aerodynamic pressure loading conditions.

Another object of the present invention is to provide for a turbine blade with near wall cooling so that the airfoil can be made thin to increase the airfoil overall heat transfer convection capability.

Still another object of the present invention is to separate the pressure side flow circuits from the suction side flow circuits in order to eliminate back flow margin design issues and high blowing ratio for the airfoil suction side film cooling holes.

BRIEF SUMMARY OF THE INVENTION

The present invention is a turbine blade with a near wall cooling flow design which is divides the blade into separate compartments to form four major cooling zones. The blade includes a leading edge region, a multiple blade mid-chord section pressure side, a multiple blade mid-chord suction side, and a blade trailing edge region. Multiple near wall cooling zones are used for the blade mid-chord section for tailoring the local heat load as well as local gas side pressure profile.

For each individual zone of the blade near wall compartment, cooling air is fed through the airfoil near wall multiple channels from the blade root section cooling air supply cavity. The near wall channel also wraps around the blade tip section to provide blade tip section cooling prior to discharging the cooling air back into the blade spent air collector cavities. Multiple collector cavities are used to divide the blade into compartments for the spent cooling air in the blade mid-chord region.

The spent cooling air from each individual collector cavity is then discharged into the hot gas surface through a showerhead and airfoil film cooling holes or trailing edge cooling slots or exit holes. Film cooling holes can be incorporated in between the near wall cooling channel or in front of the cooling channel as a counter flow heat exchange arrangement or at aft cooling channels as a parallel flow heat exchange arrangement. A similar design is also used for the cooling of the airfoil edge section.

DETAILED DESCRIPTION OF THE INVENTION

Figure 1:
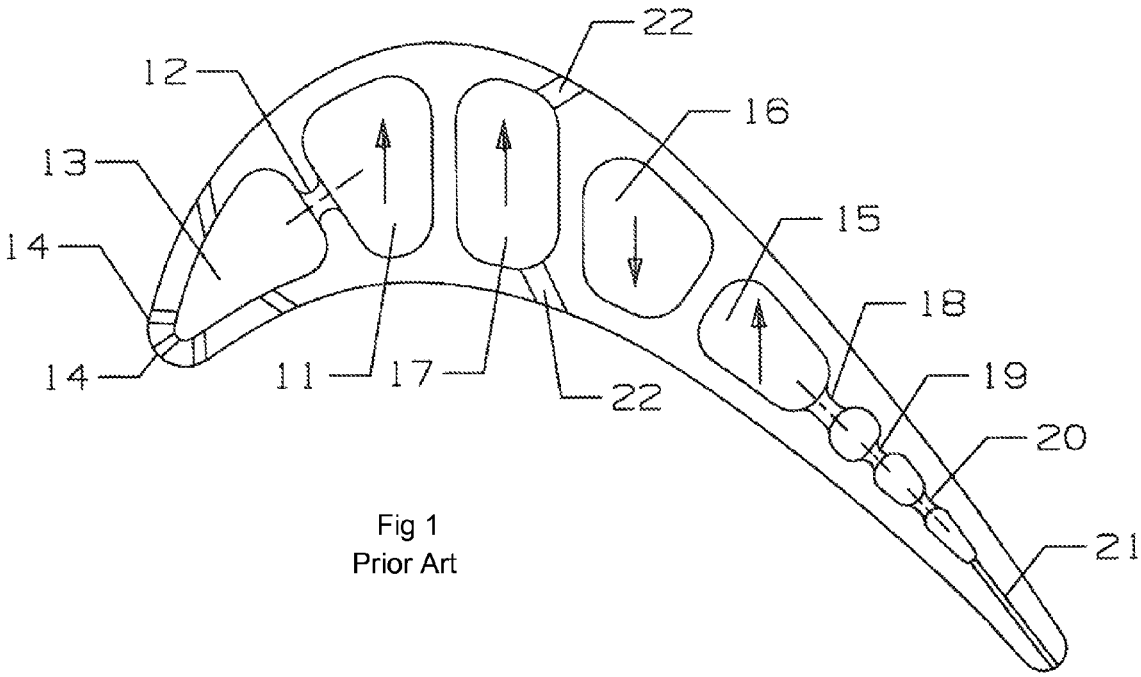
Fig 1 Prior Art
FIG. 1 shows a prior art turbine blade cooling with a serpentine flow cooling circuit.
Figure 2:
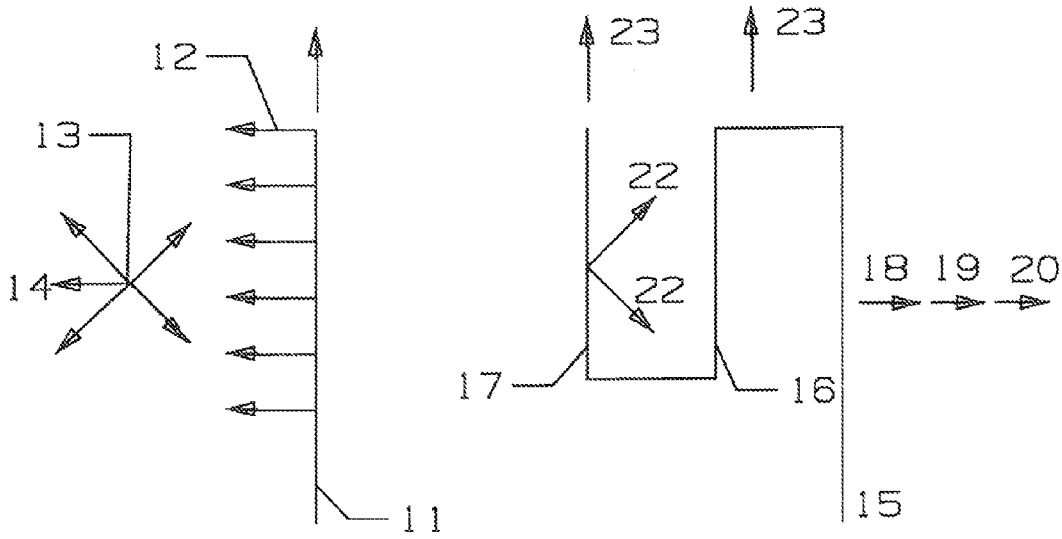
Fig 2 Prior Art
FIG. 2 shows a flow diagram of the prior art turbine blade cooling circuit of FIG. 1.
Figure 3:
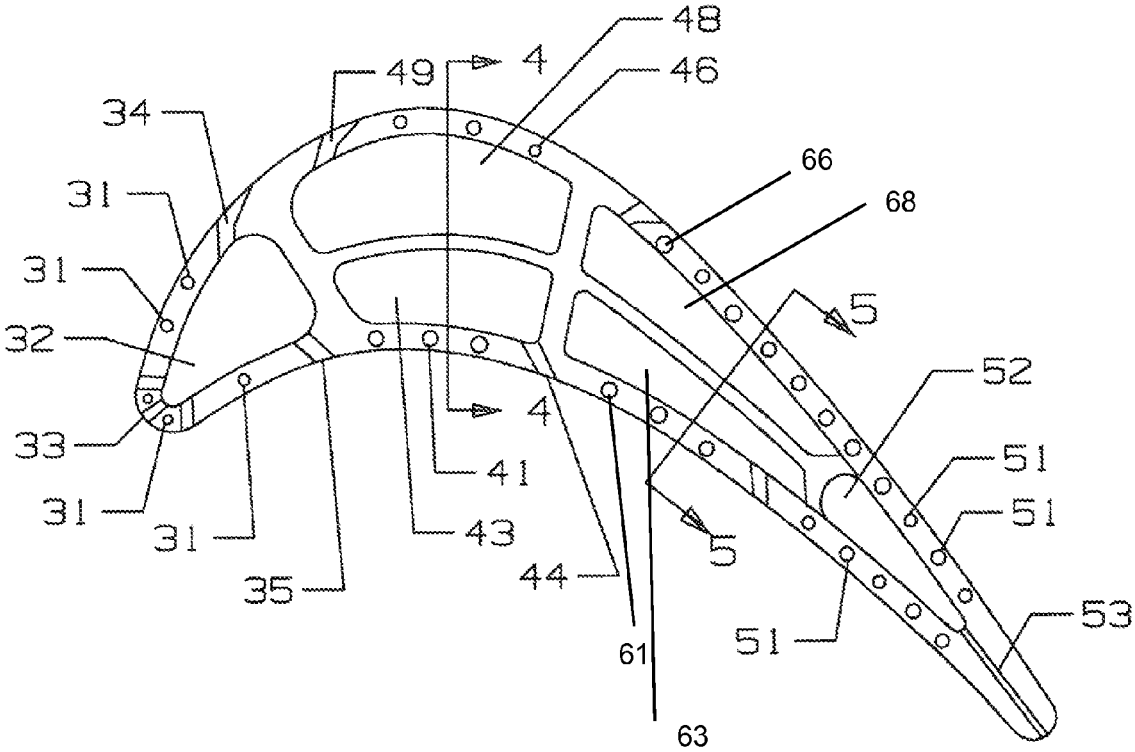
FIG. 3 shows a cross sectional view along line 3-3 of FIG. 2.
Figure 4:
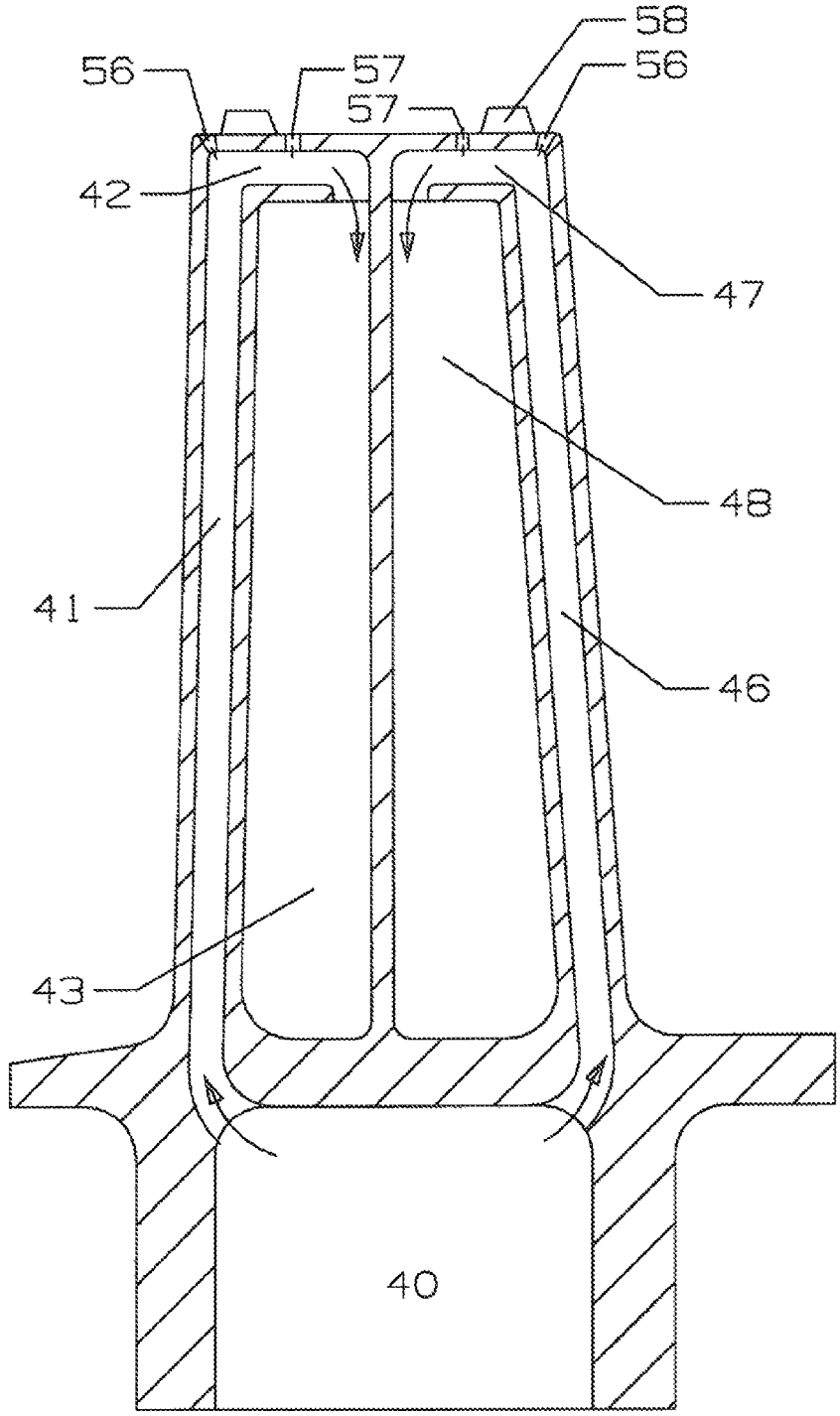
FIG. 4 shows a cross sectional view along line 4-4 of FIG. 3.
Figure 5:
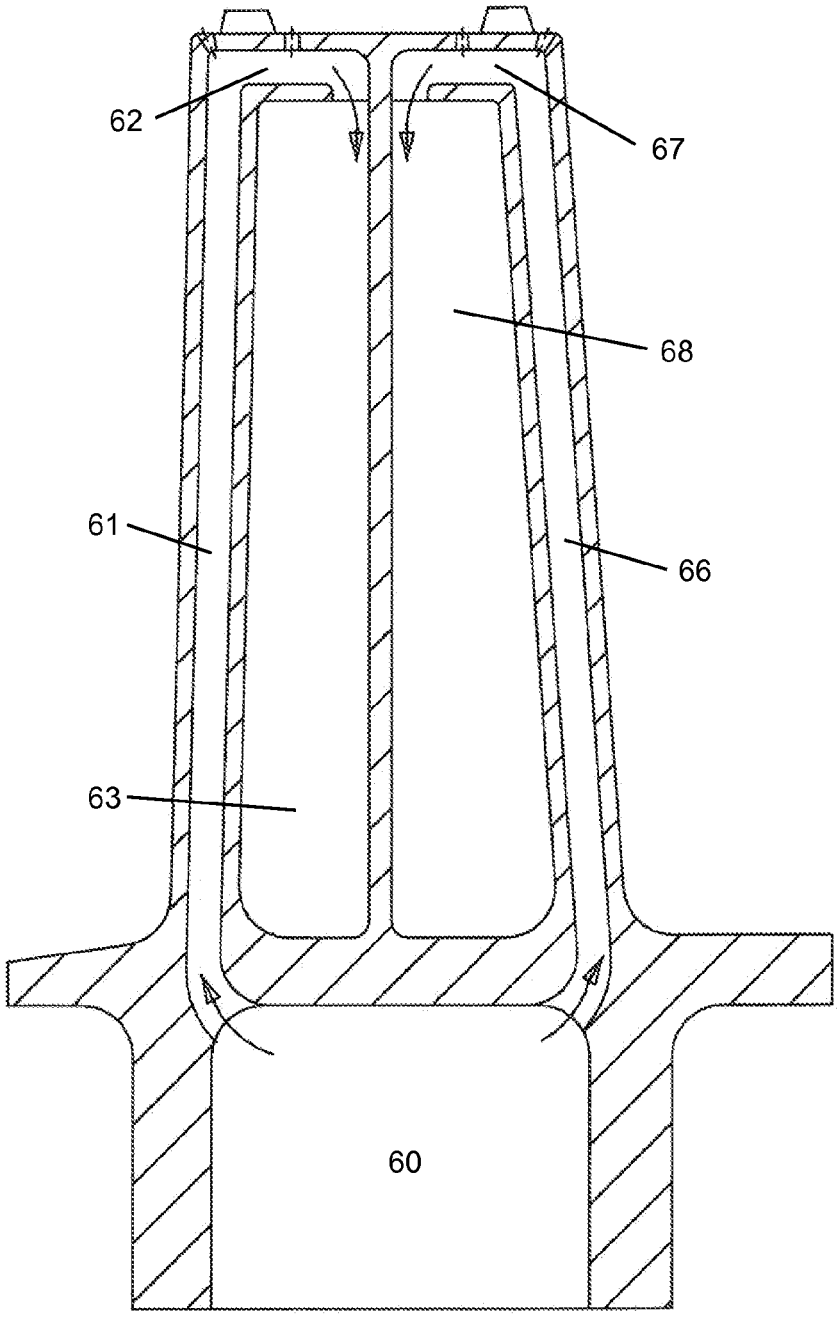
FIG. 5 shows a cross sectional view along line 5-5 of FIG. 3.

The cooling circuit for a turbine airfoil of the present invention is shown in FIGS. 2 and 3. In the first embodiment, the airfoil is a rotor blade for an industrial gas turbine engine. However, the cooling circuit of the present invention could be used in a stator vane.

The turbine blade includes a leading edge section (region) with a plurality of radial extending convection cooling flow channels 31 spaced along the blade walls of the leading edge region. The flow channels are connected to a cooling supply cavity formed below the blade in the root section which will be described below. A spent air collector cavity 32 is formed within the walls of the blade. Film cooling holes 33 form a showerhead arrangement and are connected to the spent air collector cavity. Suction side 34 and pressure side 35 film holes (also called gill holes) are located downstream from the last radial channels in the leading edge region of the blade and are also connected to the spent air collector cavity 32.

The mid-chord region of the blade includes a plurality of pressure side radial channels 41, a pressure side spent air collector cavity 43, and pressure side film cooling holes 44 connected to the collector cavity 43. The suction side of the blade has similar cooling channels and collector cavity. A plurality of suction side radial extending convection channels 46 is located in the suction side wall of the blade. A suction side spent air collector cavity 48 and a row of suction side film cooling holes 49 connected to the collector cavity 48 are also associated with the suction side radial channels 46. FIG. 3 shows a cut-away through this region of the blade as depicted in FIG. 2. A cooling supply cavity 40 is formed in the root section of the blade below the platform. The pressure side radial channels 41 and suction side radial channels 46 are connected to the cooling air supply cavity 40 and supply pressurized cooling air to the channels 41 and 46. A pressure side blade tip cooling channel 42 connects the pressure side radial channels 41 to the pressure side spent air collector cavity 43, while a suction side blade tip cooling channel 47 connects the suction side radial channels 46 to the suction side spent air collector cavity 48. As an option, blade tip cooling exit holes 56 and 57 can be used to discharge cooling air from the tip channels to the blade tip region such as a squealer tip cavity. A first cooling air exit hole 56 and a second exit hole 57 are located on opposite sides of the squealer tip rail 58. Both exit holes 56 and 57 are connected to the radial channels or the tip channel upstream from the collection cavities. As seen in FIG. 2, the pressure side collector cavity 43 is connected to a row of pressure side film cooling holes 44 extending along the spanwise direction of the blade to provide film cooling along this portion of the pressure side of the blade. Also seen in FIG. 2 is the row of suction side film cooling holes 49 connected to the suction side collector cavity 48 to provide film cooling along this portion of the suction side of the blade.

This pattern of radial channels, tip channels, and collector cavities is repeated another time in the blade mid-chord region between the pattern described above and the trailing edge region of the blade. A cooling air supply cavity 60 is located in the root of the blade below the area to be cooled, and a plurality of radial channels 61 and 66 connected to the supply cavity 60 and extending along the pressure side wall and the suction side wall of the blade provides convection cooling for the blade. The radial channels 61 and 66 flow into the tip channels 62 and 67 respectively and then into the respective pressure side or suction side spent air collector cavities 63 and 68. Pressure side film cooling holes are connected to the pressure side collector cavity 63, and suction side film cooling holes are connected to the suction side collector cavity 68. All of the radial channels 61 and 66 on the pressure side and the suction side could be connected to a common cooling air supply cavity 40, or each of the four section with collector cavities shown in FIG. 3 (the leading edge collector, the forward mid-chord collectors, the aft mid-chord collectors, and the trailing edge collector) can be connected to a separate cooling air supply cavity 60 depending upon the supply pressure from the sources of pressurized cooling air used to pass through the respective collectors.

The blade of FIGS. 2 and 3 operates as follows. Pressurized cooling air, such as that diverted from the compressor of the gas turbine engine, is directed into a common cooling air supply cavity formed in the root of the blade and below the platform. The pressurized cooling air then flows up the various radial cooling channels spaced around the leading edge and the pressure side and suction side of the blade to provide convection cooling. The cooling air flowing in the pressure side and suction side radial channels then flows over the blade tip through the tip channels, and then into the respective collector cavity. Cooling air in the separate collector cavities then flow out the blade through one or more rows of film cooling holes. The leading edge collector cavity supplies cooling air to the showerhead arrangement and the gill holes, the mid-chord collector cavities (four in this embodiment), then cooling air to the rows of film cooling holes on the pressure side and suction side walls of the blade. The trailing edge collector cavity supplies cooling air to the exit holes or exit ducts spaced along the trailing edge region. In a further embodiment, blade tip exit holes can be connected to the tip channels to discharge cooling air into a squealer tip cavity from on the blade tip.

By using the separated collector cavities and radial cooling channels, each compartment can be separately designed for cooling air flow and pressure in order to provide just the right amount of cooling for that particular section of the blade. Each individual cooling zone can be independently designed based on the local heat load and aerodynamic pressure loading conditions. The design flexibility for a blade is increased in order to re-distribute cooling flow and/or add cooling flow for each zone and therefore increase the growth potential for the cooling design. Near wall cooling is utilized for the airfoil and reduces conduction thickness and increases airfoil overall heat transfer convection capability, thereby reducing the airfoil mass average metal temperature. The pressure side flow circuits are separated from the suction side flow circuits which eliminates the blade mid-chord cooling flow uneven distribution due to film cooling flow uneven distribution, film cooling hole size, and mainstream pressure variation. The pressure side flow circuits are separated from the suction side flow circuits and therefore eliminate the design issue such as the back flow margin (BFM) and high blowing ratio for the blade suction side film cooling holes. Separation of the blade mid-chord flow circuits eliminates flow variation between pressure and suction flow split within a cooling flow cavity.

I claim the following:

1. A turbine blade having a leading edge and a trailing edge, and a pressure side and a suction side, the turbine blade comprising:

a cooling air supply cavity formed within a root portion of the blade;

a plurality of pressure side radial extending cooling channels connected to the supply cavity;

a plurality of suction side radial extending cooling channels connected to the supply cavity;

a pressure side collection cavity formed between the mid-chord of the blade and the pressure side radial extending cooling channels, the pressure side collection cavity being in fluid communication with the plurality of pressure side radial extending cooling channels;

a suction side collection cavity formed between the mid-chord of the blade and the suction side radial extending cooling channels, the suction side collection cavity being in fluid communication with the plurality of suction side radial extending cooling channels;

a row of pressure side film cooling holes connected to the pressure side collection cavity; and, a row of suction side film cooling holes connected to the suction side collection cavity.

2. The turbine blade of claim 1, and further comprising:

between the cooling supply cavity and the external surface of the blade, the pressure side collection cavity and the pressure side radial channels are fluidly separated from the suction side collection cavity and the suction side radial channels.

3. The turbine blade of claim 1, and further comprising:

a pressure side tip channel forming the fluid communication between the pressure side radial channels and the pressure side collection cavity; and, a suction side tip channel forming the fluid communication between the suction side radial channels and the suction side collection cavity.

4. The turbine blade of claim 1, and further comprising:

a pressure side tip exit cooling hole in fluid communication with the pressure side radial channels to discharge cooling air to the tip of the blade; and, a suction side tip exit cooling hole in fluid communication with the suction side radial channels to discharge cooling air to the tip of the blade.

5. The turbine blade of claim 1, and further comprising:

the leading edge region with a leading edge region collection cavity formed therein;

a plurality of leading edge region radial channels extending along the pressure side and the suction side of the leading edge region, the plurality of leading edge region radial channels being in fluid communication with the leading edge region collection cavity; and, a showerhead arrangement of film cooling holes connected to the leading edge region collection cavity.

6. The turbine blade of claim 5, and further comprising:

the trailing edge region with a trailing edge region collection cavity formed therein;

a plurality of trailing edge region radial channels extending along the pressure side and the suction side of the trailing edge region, the plurality of trailing edge region radial channels being in fluid communication with the trailing edge region collection cavity; and, a plurality of exit cooling holes or ducts connected to the trailing edge region collection cavity.

7. The turbine blade of claim 1, and further comprising:

a second plurality of pressure side radial extending cooling channels in fluid communication with a second pressure side collection cavity, a second set of pressure side film cooling holes connected to the second pressure side collection cavity;

a second plurality of suction side radial extending cooling channels in fluid communication with a second suction side collection cavity, a second set of suction side film cooling holes connected to the second suction side collection cavity; and, the second pressure and suction collection cavities being located between the first pressure and suction collection cavities and a trailing edge collection cavity.

8. The turbine blade of claim 7, and further comprising:

the second pressure and suction radial extending cooling channels being connected to a second cooling air supply cavity formed within the root of the blade, the second cooling air supply cavity being separate from the first cooling supply cavity.

9. The turbine blade of claim 7, and further comprising:

the second pressure and suction radial extending cooling channels being connected to the cooling air supply cavity in which the first pressure and suction radial extending cooling channels are connected to.

10. The turbine blade of claim 7, and further comprising:

between the cooling supply cavity and the external surface of the blade, the pressure side collection cavity and the pressure side radial channels are fluidly separated from the suction side collection cavity and the suction side radial channels.

11. The turbine blade of claim 7, and further comprising:

a second pressure side tip exit cooling hole in fluid communication with the second set of pressure side radial channels to discharge cooling air to the tip of the blade; and, a second suction side tip exit cooling hole in fluid communication with the second set of suction side radial channels to discharge cooling air to the tip of the blade.

12. The turbine blade of claim 1, and further comprising:

cooling air that flows into the pressure side collection cavity only flows out from the blade through the pressure side film cooling holes; and, cooling air that flows into the suction side collection cavity only flows out from the blade through the suction side film cooling holes.

13. The turbine blade of claim 7, and further comprising:

the leading edge region with a leading edge region collection cavity formed therein;

a plurality of leading edge region radial channels extending along the pressure side and the suction side of the leading edge region, the plurality of leading edge region radial channels being in fluid communication with the leading edge region collection cavity;

a showerhead arrangement of film cooling holes connected to the leading edge region collection cavity;

the trailing edge region with a trailing edge region collection cavity formed therein;

a plurality of trailing edge region radial channels extending along the pressure side and the suction side of the trailing edge region, the plurality of trailing edge region radial channels being in fluid communication with the trailing edge region collection cavity; and, a plurality of exit cooling holes or ducts connected to the trailing edge region collection cavity.

14. The turbine blade of claim 7, and further comprising:

the row of pressure side film cooling holes connected to the first pressure side collection cavity is located downstream from a first set of pressure side radial cooling channels; and, the row of suction side film cooling holes connected to the first suction side collection cavity is located upstream from a first set of suction side radial cooling channels.

15. The turbine blade of claim 14, and further comprising:

the row of pressure side film cooling holes connected to the second pressure side collection cavity is located downstream from the second set of pressure side radial cooling channels;

the row of suction side film cooling holes connected to the second suction side collection cavity is located upstream from the second set of suction side radial cooling channels.

16. The turbine blade of claim 1, and further comprising:

a squealer tip formed on the tip of the blade with a tip rail extending along both the pressure side and the suction side of the blade tip;

a first exit cooling air hole connected to the pressure side or suction side radial channel and opening onto the blade tip outward from the tip rail; and, a second exit cooling hole connected to the pressure side or suction side radial channel and opening onto the blade tip inward from the tip rail.

* * * * *